US006318031B1

(12) United States Patent
Nakamura et al.

(10) Patent No.: US 6,318,031 B1
(45) Date of Patent: Nov. 20, 2001

(54) BASE STRUCTURE OF BUILDING AND CONSTRUCTION METHOD THEREOF

(75) Inventors: Takuzo Nakamura, Miyagi; Toshiaki Kobayashi, Fukushima, both of (JP)

(73) Assignee: Nakamura Bussan Co., Ltd., Miyagi (JP)

( * ) Notice: Subject to any disclaimer, the term of this patent is extended or adjusted under 35 U.S.C. 154(b) by 0 days.

(21) Appl. No.: 09/440,275

(22) Filed: Nov. 15, 1999

(30) Foreign Application Priority Data

Nov. 19, 1998 (JP) ..... 10-346578

(51) Int. Cl.[7] ..... E04B 1/98
(52) U.S. Cl. ..... 52/167.1
(58) Field of Search ..... 52/167.7, 167.8, 52/167.9, 167.1

(56) References Cited

U.S. PATENT DOCUMENTS 4,593,502 * 6/1986 Buckle ..... 52/167
5,016,413 * 5/1991 Counihan ..... 52/391

FOREIGN PATENT DOCUMENTS 297 09 300 2/1998 (DE) .
2 120 167 11/1983 (GB) .
9-165758 6/1997 (JP) .
9273160 * 10/1997 (JP) ..... E02D/27/01

* cited by examiner

*Primary Examiner*—Carl D. Friedman
*Assistant Examiner*—Steve Varner
(74) *Attorney, Agent, or Firm*—Kanesaka & Takeuchi

(57) ABSTRACT

A recess is formed by excavating ground, and a base support formed by a synthetic resin molded foam is laid in the recess or resin foam concrete is placed in the recess to provide a base support formed by the resin foam concrete in the recess. A plurality of vibration absorbers is mounted on the base support in such a manner as to be parallel to and spaced from each other at specific intervals. The vibration absorber is formed by a plate-like synthetic resin molded foam having a large number of through-holes which pass through the molded foam in the thickness direction or a plate-like synthetic resin molded foam having a large number of gaps between particles. Concrete is placed on the base support on which the vibration absorbers have been mounted, to form a base. The three components, that is, the base support, vibration absorbers, and base are integrated to each other to constitute a base structure of a building.

8 Claims, 5 Drawing Sheets

BASE STRUCTURE OF BUILDING AND CONSTRUCTION METHOD THEREOF

BACKGROUND OF THE INVENTION AND DESCRIPTION OF THE RELATED ART

The present invention relates to a base structure of a building, capable of improving earthquake-resistant and vibration-proof of the building against earthquake, traffic vibration, etc. and effectively preventing subsidence of ground, and to a construction method thereof.

Vibration due to earthquake, vibration accompanied by passing of large-sized vehicles such as buses and trucks, that is, traffic vibration, or vibration of mechanical operation of machines in works exerts adverse effect on the base of a building, and at the worst case, it causes dip-slip or collapse of the building, or ground subsidence.

Conventionally, to improve earthquake-resistant and vibration-proof of a building against earthquake and vibration due to traffic, etc. and to prevent ground subsidence, there has been adopted a means of increasing the amounts of concrete and reinforcements for constructing the base of a building, a means for supporting the base of the building with piles, or a means of reinforcing soft ground by using a cement based ground improvement material.

The improvement of earthquake-resistant and vibration-proof and the prevention of ground subsidence by the above-described means, however, is not only economically disadvantageous in that a large number of materials must be used to thereby raise the construction cost, but also insufficient to realize the above-described purpose even if a large number of materials are used.

Japanese Patent Laid-open Nos. Hei 9-165758, Hei 9-273160 and Hei 11-256596 have disclosed a base structure of a building, in which a base support formed by a synthetic resin molded foam is laid under the base of the building. Such a base structure is very effective to improve earthquake-resistant and vibration-proof and to prevent ground subsidence.

Since, large earthquake disasters have occurred in recent years, as a starting point of examination, the conventional safety standard has been required to be reviewed, and to meet such a requirement, it is expected to develop a stronger earthquake-resistant base structure of a building.

OBJECT AND SUMMARY OF THE INVENTION

An object of the present invention is to provide a base structure of a building, capable of efficiently absorbing vibration waves of earthquake and traffic vibration, and vibration waves occurring along with mechanical operation of machines in works, thereby significantly improving earthquake-resistant and vibration-proof of the building.

Another object of the present invention is to provide a base structure of a building, capable of improving earthquake-resistant and vibration-proof and effectively preventing ground subsidence.

A further object of the present invention is to provide a method of constructing a base structure of a building capable of improving earthquake-resistant and vibration-proof and preventing ground subsidence.

The base structure of a building according to the present invention includes a base support laid at a location where the building is to be constructed, a base formed on the base support, and vibration absorbers interposed between the base support and the base. The base support is formed by a plate-like synthetic resin molded foam, and is laid under the ground surface. The synthetic resin molded foam may be preferably made from a material which is selected from polystyrene, polypropylene, and polyethylene, and which has a compressive strength ranging from 3 to 25 t/m$^2$. The base support may be formed not only by the resin foam plate but also by resin foam concrete as a mixture of synthetic resin foamed particles and concrete.

The base is the concrete structure formed by placing concrete on the base support.

Each of the vibration absorbers interposed between the base support and the base has a porous structure having a large number of cavities. As such a porous structure, a synthetic resin foam can be most preferably used. The synthetic resin foam may be preferably made from a material selected from polystyrene, polypropylene, and polyethylene and may preferably have a porosity ranging from 15 to 40%.

A plurality of the vibration absorbers may be provided between the base support and the base in such a manner as to be spaced at specific intervals on the base support.

The base structure of the present invention is constructed by the steps of excavating ground and removing soil to form a recess, laying the base support formed by a synthetic resin molded foam in the recess or placing resin foam concrete in the recess to provide the base support formed by the resin foam concrete in the recess, mounting a plurality of the vibration absorbers on the base support in such a manner that the vibration absorbers are spaced at specific intervals, and placing concrete on the base support, to form the base of a building on the base support.

The base structure of the present invention is composed of the base support formed by a synthetic resin molded foam or resin foam concrete, the base formed by concrete formed on the base support, and vibration absorbers, each having a large number of cavities, interposed between the base support and the base. As a result, when there occur vibration waves of earthquake and traffic vibration and vibration waves accompanied by mechanical operation of machines in works, the energy of the vibration waves is damped as the vibration waves propagate through the base support and the vibration absorbers, and also the vibration waves transmitting from the vibration absorbers to the base are reflected from the boundary plane between the concrete plane of the base and the vibration absorbers. In this way, according to the present invention, it is possible to efficiently damp the energy of vibration waves and hence to significantly improve the earthquake-resistant, earthquake-proof, and vibration-proof of the building.

The base structure of the present invention is advantageous in reducing the cost of the materials used, simplifying the construction work and shortening the construction period, and reducing the construction cost.

DETAILED DESCRIPTION OF THE PREFERRED EMBODIMENT OF THE INVENTION

Hereinafter, the present invention will be described in detail with reference to the drawings.

Figure 1:
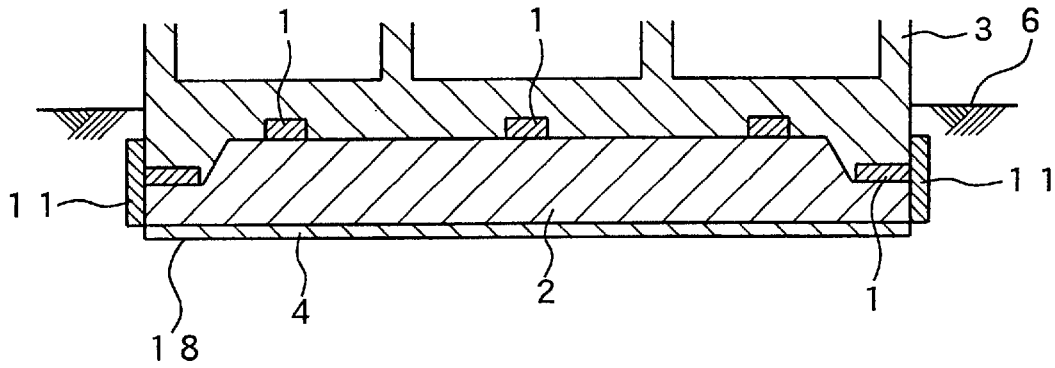
FIG. 1 is a vertical sectional view showing an embodiment in which a base structure of the present invention applied to a mat base.

FIG. 1 shows an embodiment in which the present invention is applied to a base configured as a mat base, in which reference numeral 1 designates a vibration absorber, 2 is a base support, and 3 is a base.

The base support 2 formed by a synthetic resin molded foam is laid at a position at which a building is to be constructed. A recess 18 is formed by excavating the ground and removing soil, and the base support 2 is laid in the recess 18. Reference numeral 4 designates gravel, and 6 is ground surface. To be more specific, the base support 2 is configured by a combination of a plurality of plate bodies formed by a synthetic resin molded foam.

The synthetic resin molded foam may be produced by an extrusion expansion molding method or beads expansion molding method.

The base support 2, which receives a dead weight of a building and a load applied to the building, is required to have a specific strength. To exhibit a specific vibration wave energy damping effect without occurrence of destroy due to the dead weight of the building and the load applied to the building, the compressive strength of the base support may be preferably in a range of 3 to 25 t/m$^2$. Examples of the materials of the synthetic resin molded foam for forming the base support 2 may include polystyrene, polypropylene, polyethylene, polyurethane, and polyvinyl chloride; however, polyurethane has a problem associated with durability because of occurrence of hydrolysis and polyvinyl chloride has a problem associated with environmental pollution due to occurrence of hydrochloric acid gas upon combustion. Based on the facts described above, it may be preferred to select either of polystyrene, polypropylene and polyethylene as a molding material of the synthetic resin molded foam. The expansion ratio of the molded foam may be preferably in a range of 10 to 60 times. The thickness of the base support 2 may be freely set but may be preferably set at a value in a range of 10 to 100 cm.

Figure 7:
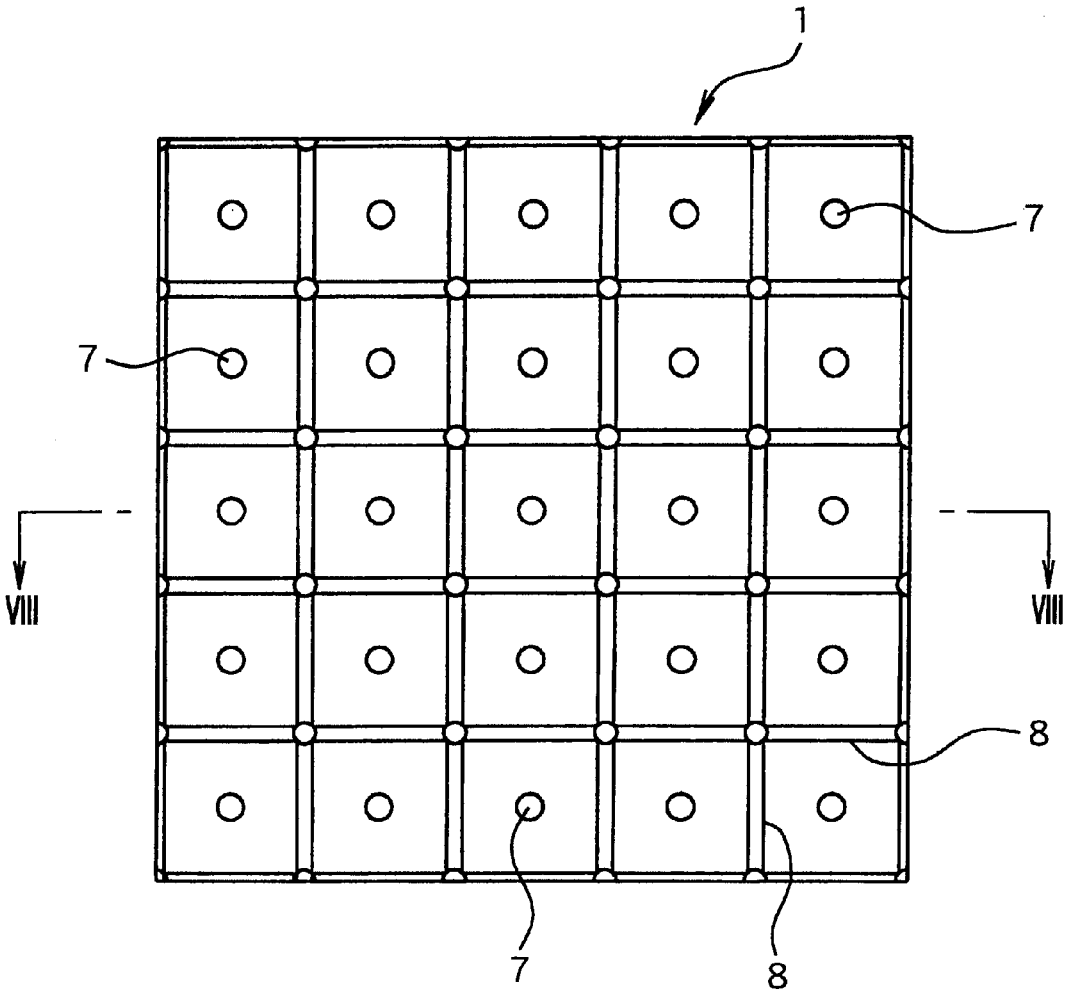
FIG. 7 is a plan view showing one example of the vibration absorber.

A plurality of vibration absorbers 1 is mounted on the upper surface of the base support 2 thus laid in such a manner as to be spaced at specific intervals. The vibration absorber 1, as shown by a plan view of FIG. 7, is formed into a plate shape. A plurality of the plate-shaped vibration absorbers 1 is arranged in a belt-shape, to form one-row of the vibration absorbers. The one-row of vibration absorbers may be continuously provided or be discontinuously formed with an interval put between two, adjacent to each other, of the vibration absorbers. A plurality of rows of the vibration absorbers is arranged on the base support 2 in parallel to each other. In the embodiment shown in FIG. 1, three rows of the vibration absorbers 1 are provided.

Figure 8:
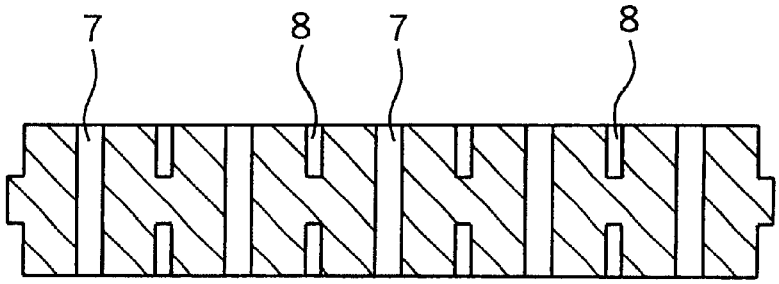
FIG. 8 is a vertical sectional view taken on line VIII—VIII of FIG. 7.
Figure 9:
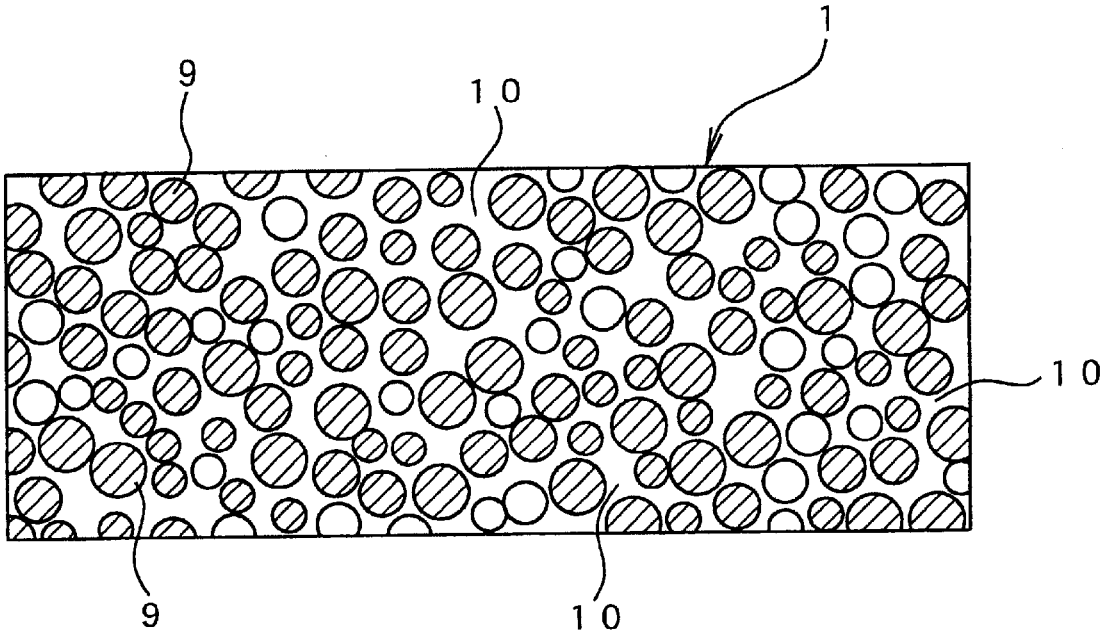
FIG. 9 is a vertical sectional view showing another example of the vibration absorber.

The vibration absorber 1 is configured as a porous structure having a large number of cavities. Examples of the porous structures are shown in FIGS. 7 to 9. The porous structure shown in FIGS. 7 and 8 has grooves 8 formed on the front and back sides of the porous structure in such a manner as to be arranged in a grid-pattern, and through-holes 7 passing through the porous structure in the thickness direction. These grooves 8 and the through-holes 7 constitute cavities of the vibration absorber 1.

The vibration absorber 1 having the porous structure shown in FIGS. 7 and 8 may be preferably formed by a synthetic resin molded foam. The synthetic resin molded foam can be produced by filling a mold having a split structure with pre-foamed particles, then heating and foaming them. Additionally, in the structure shown in FIGS. 7 and 8, the though-holes 7 may be replaced with blind holes.

A porous structure shown in FIG. 9 is formed by a synthetic resin molded foam in which foam particles 9 are imperfectly fused to each other to form cavities 10. Such a porous structure may be preferably produced by the beads expansion molding method. In producing the porous structure by the beads expansion molding method, by suitably adjusting the inner pressure of pre-foamed particles, foaming temperature, etc., it is possible to create an imperfect fusion state in which when the pre-foamed particles are foamed and expanded, the foamed particles do not perfectly fill gaps between the particles, and hence to obtain a molded foam having gaps between particles.

Figure 10:
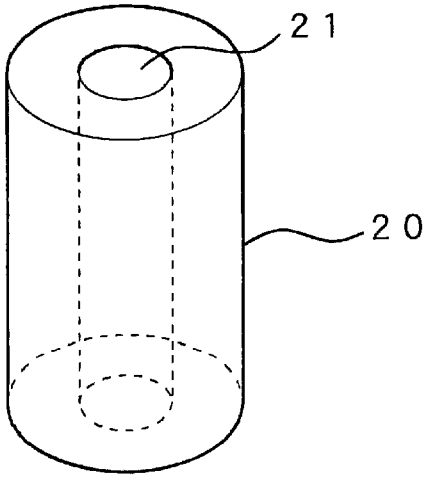
FIG. 10 is a perspective view showing a cylindrical pre-foamed particle.

The synthetic resin molded foam having a large number of cavities can be also produced by using pre-foamed particles having a hollow structure in cross-section. As the pre-foamed particles having a hollow structure in cross-section, a cylindrical particle 20 shown in FIG. 10 can be, not exclusively, used. Since the pre-foamed particles 20 having a hollow structure in cross-section have originally cavities 21, a molded foam having a large number of cavities can be obtained by heating the pre-foamed particles 20 put in a mold so as to foam and expand them, thereby fusing the particles to each other. The molded foam having gaps between foamed particles can be also produced by using indeterminately formed pre-foamed particles.

The porous structure can be produced not only by the above beads expansion molding method but also by the extrusion expansion molding method. The porous structure of the synthetic resin molded foam may be a continuous cell structure or an independent cell structure.

According to the present invention, examples of the materials for forming the vibration absorber may include polystyrene, polypropylene, polyethylene, and polyester.

Assuming that the ratio (%) of cavities to the total volume of a vibration absorber is defined as a porosity, the porosity of the vibration absorber according to the present invention may be preferably in a range of 15 to 40%. If the porosity is less than 15%, the vibration wave energy damping effect is insufficient, while if it is more than 40%, the strength of the vibration absorber is poor.

Since the dead weight of a building and a load applied to the building are also applied to the vibration absorber, in order for the vibration absorber to exhibit a specific vibration wave energy damping effect, the compressive strength of the vibration absorber may be preferably in a range of 3 to 25 t/m$^2$. The size of the vibration absorber may be freely determined but, if the vibration absorber is formed into a square shape in cross-section as shown in FIG. 1, the size of the vibration absorber may be preferably set such that the longitudinal length is in a range of 100 to 200 cm, the lateral length is in a range of 100 to 200 cm, and the thickness is in a range of 5 to 20 cm.

Concrete is placed on the base support 2 on which the vibration absorbers 1 have been mounted, to form the base 3.

The vibration absorber 1 having a large number of cavities acts to damp the energy of vibration waves for reducing transmission of the vibration waves to the building. The vibration waves propagating through the vibration absorber 1 are reflected from a boundary plane between the vibration absorber 1 and the base 3, to damp the energy of the vibration waves. In this way, according to the present invention, by allowing the vibration waves transmitting from the layer having a small characteristic impedance to the layer having a large characteristic impedance to be reflected from the boundary plane therebetween, it is possible to reduce the transmission energy of the vibration waves.

In particular, since the boundary plane between the vibration absorber 1 and the base support 2 has irregularities, the vibration waves are irregularly reflected from the boundary plane, so that it is possible to enhance the effect of reducing the transmission energy of the vibration waves.

When the vibration waves propagate to the base support 2 formed by the synthetic resin molded foam, the base support 2 is elastically deformed, to damp the energy of the vibration waves. According to the present invention, by the two functions of the vibration absorber 1 and the base support 2, it is possible to efficiently damp the energy of the vibration waves.

Since the base 3 is formed by concrete, the three components, that is, the base support 2, vibration absorbers 1 and the base 3 are integrated to each other by a joining force of concrete.

Figure 2:
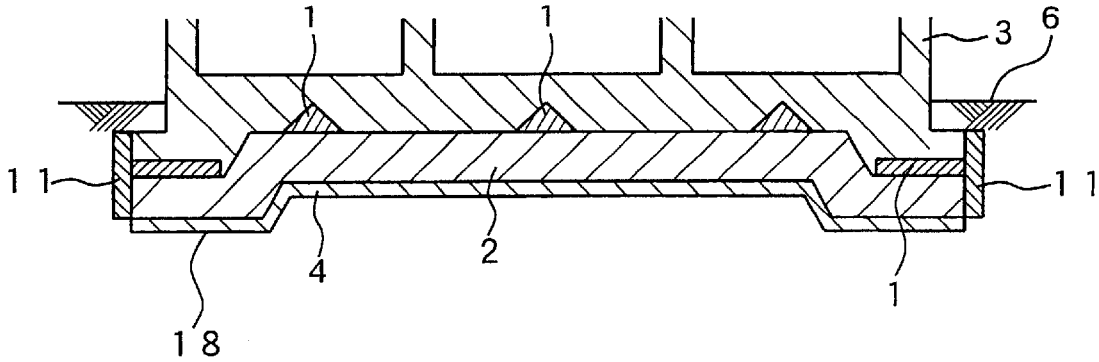
FIG. 2 is a vertical sectional view showing another embodiment of the base structure of the present invention in which vibration absorbers each being formed into a triangular shape in cross-section are provided.

The shape of the vibration absorber is not limited to the square shape in cross-section shown in FIG. 1 but may be a triangular shape shown in FIG. 2, and further, while not shown, it may be a semi-circular shape in cross-section. The plane shape of the vibration absorber is not limited to the square shape shown in FIG. 7 but may be a circular or polygonal shape.

Since the opening width of each of the cavities of the vibration absorber is small, it is not filled with concrete or soil and sand; however, if needed, the vibration absorber may be covered with a sheet for preventing concrete or soil and sand from permeating in the cavities. As such a sheet, there can be used a sheet made from cloth such as nonwoven fabric, a rubber sheet, etc.

Plate bodies 11 made from a synthetic resin molded foam can be provided on all or part of side surfaces of the base support 2 as shown in FIG. 1. As the material of the synthetic resin molded foam for forming the plate bodies 11, there can be used the same material as that of the synthetic resin molded foam for forming the vibration absorber 1. By providing the plate bodies 11 on the side surfaces of the base support 2, it is possible to further damp the energy of vibration waves propagating to the building in the lateral direction and the upwardly tilting direction.

According to the present invention, the material for forming the base support 2 is not limited to the synthetic resin molded foam but may be resin foam concrete. The resin foam concrete is obtained by mixing concrete with synthetic resin foamed particles. As the synthetic resin foamed particles, there can be used the same as the above pre-foamed particles used for production of the synthetic resin molded foam by the beads expansion molding method. Examples of the materials for forming the foamed particles to be mixed with concrete may include polystyrene, polyethylene, polyethylene, etc., like the synthetic resin for forming the base support 2 without concrete. The mixing ratio between concrete and the synthetic resin foamed particles can be determined by conversion thereof to the specific gravity of the resin foam concrete. That is to say, the mixing ratio is selected such that the specific gravity of the resin foam concrete is in a range of 0.3 to 1.3 $t/m^3$.

To construct the base structure of the present invention, first, the earthquake characteristic of ground of a planned location at which a building is to be constructed, traffic vibration data, etc. are analyzed, and on the basis of the analyzed result, dimensions and compressive strengths of the base support 2 and the vibration absorber 1 are determined.

The recess 18 is formed in the ground by excavating the ground and removing soil. The depth of the recess 18 may be preferably in a range of 30 to 100 cm. Gravel 4 is laid on the floor of the recess 18, and is then compacted by using a hammer. Sand or pit sand is scattered on the gravel 4 to fill gaps between particles of the gravel 4, and then the gravel 4 is further compacted by using the hammer.

The base support 2 formed by the synthetic resin molded foam is laid on the gravel 4. In the case of forming the base support 2 by resin foam concrete, the resin foam concrete is placed on the gravel 4, and is cured to be hardened.

A plurality of the vibration absorbers 1 is mounted on the base support 2 in such a manner as to be spaced at specific intervals. Each vibration absorber 1 may be preferably located at a position to which the dead weight of a building and a load applied to the building are not largely applied. Then, concrete is placed on the base support 2 on which the vibration absorbers 1 have been mounted, and is cured to be hardened, to form the base 3. While not particularly shown, in formation of the base 3, reinforcing steel bars are arranged before placing of concrete. In the case where the base 3 is configured as a mat base, the weight of the base 3 is determined such that the pressure applied from the base 3 to the base support 2 and the vibration absorbers 1 is in a range of 0.5 to 2.0 $kg/cm^2$.

If the frequency of vibration waves propagating to ground upon occurrence of vibration is the same as the characteristic frequency of the building and the base structure, there occurs resonance of vibration and the quake of the building becomes larger, and accordingly, it is required to make both the frequencies different from each other. For this purpose, the compressive strength of the base support may be suitably adjusted.

Figure 3:
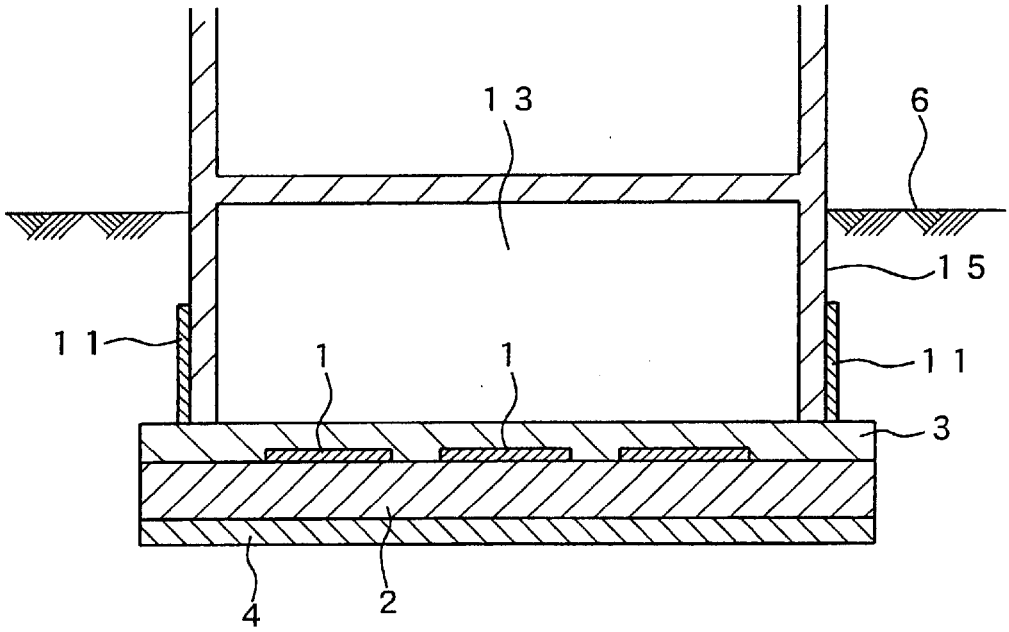
FIG. 3 is a vertical sectional view showing a further embodiment in which the base structure of the present invention is applied to a building having a basement.

The base structure of the present invention can be similarly applied to a building having a basement 13 as shown in FIG. 3. FIG. 3 shows an embodiment having a configuration basically similar to that of the base structure shown in FIG. 1, in which the base 3 is configured as a mat base. In the base structure shown in FIG. 3, the vibration wave energy damping effect can be obtained by providing the plate bodies 11 formed by the synthetic resin molded foam only on side surfaces of an outer wall 15 of the underground room 13; however, the plate bodies 11 may be provided on the side surfaces of the base support 2, in addition to the side surfaces of the outer wall 15.

Figure 4:
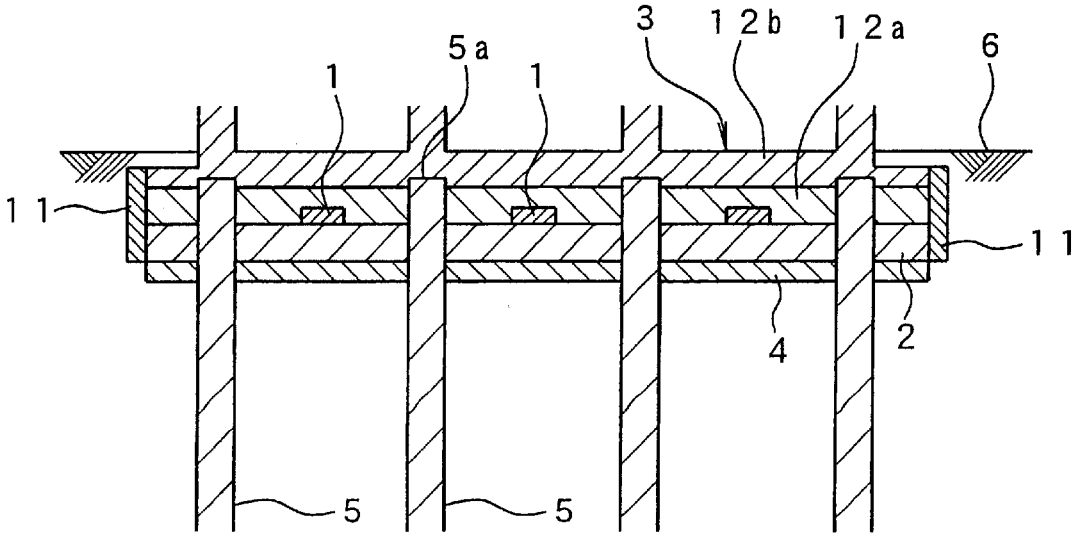
FIG. 4 is a vertical sectional view showing a further embodiment in which the base structure of the present invention is applied to a pile base.
Figure 5:
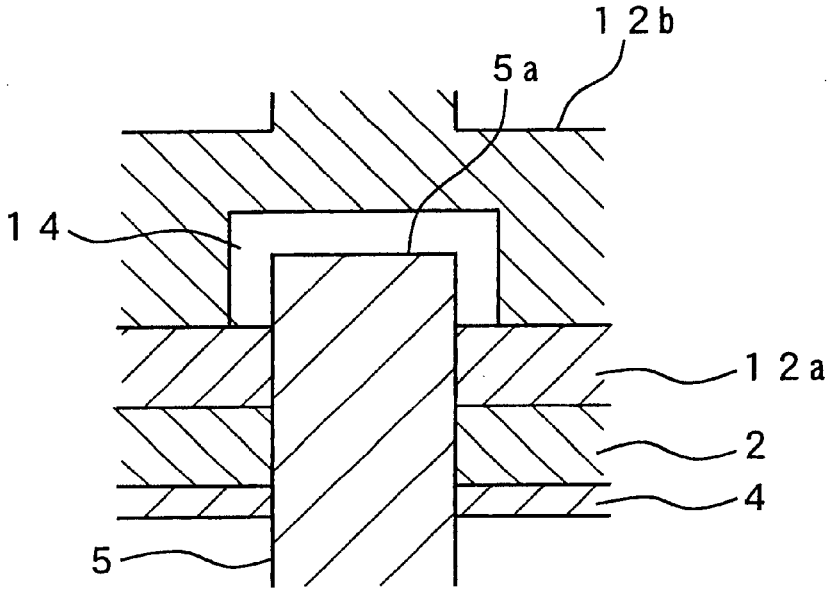
FIG. 5 is a detailed vertical sectional view showing a state in which each gap is formed between piles and the base of the pile base structure shown in FIG. 4.
Figure 6:
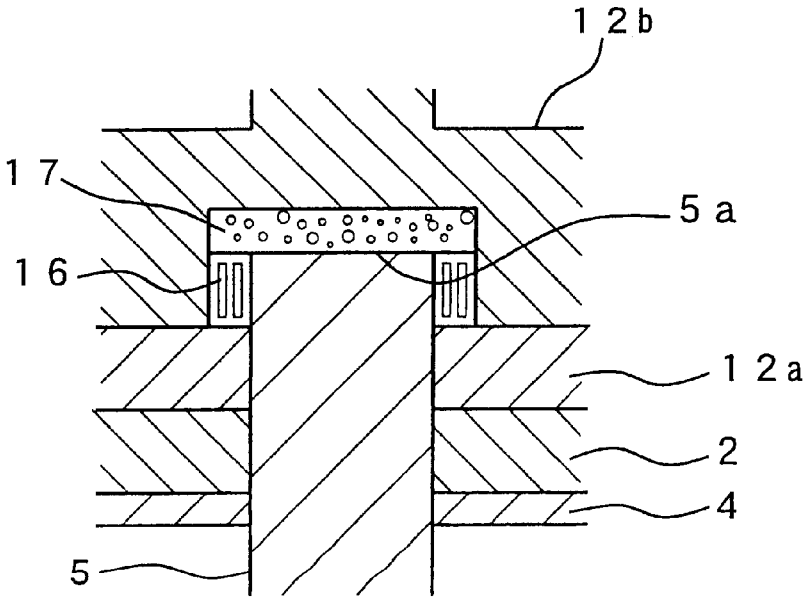
FIG. 6 is a vertical sectional view showing a state in which dampers or the like are provided in the gap shown in FIG. 5.

FIG. 4 shows an embodiment in which the base structure of the present invention is applied to a pile base. The pile structure is constructed by excavating the ground and removing soil; driving piles 5; laying gravel 4 and providing the base support 2 on the gravel 4; mounting the vibration absorbers 1 on the base support 2; placing concrete on the base support 2, and curing and solidifying it, to form a first concrete board 12*a*; and arranging reinforcing steel bars on the first concrete board 12*a*, and placing concrete, to form a second concrete board 12*b*. The first concrete board 12*a* and the second concrete board 12*b* constitute the base 3. Gaps 14 are formed between upper ends 5*a* of the piles 5 and the base 3 as shown in FIG. 5. With this structure, it is possible to improve the vibration wave energy damping effect. As shown in FIG. 6, horizontal impact absorbers 16 and a vertical impact absorber 17 may be provided in each gap 14. Each of these impact absorbers 16 and 17 can be made from a rubber material, a synthetic resin molded foam, sand, a spring, etc. With this configuration, it is possible to similarly improve the vibration wave energy damping effect.

The base structure of the present invention can be similarly applied to a cloth base, an independent base, etc.

According to the base structure of the present invention, upon provision of the base support formed by the synthetic resin molded foam, soil heavier than the synthetic resin molded foam is excavated and removed and the synthetic resin molded foam lighter than soil is laid under the base, so that it is possible to reduce the subsidence stress of ground on which the building is constructed and hence to effectively prevent subsidence of ground on which the building is constructed.

What is claimed is:

1. A base structure of a building, comprising:

a base support formed by a synthetic resin molded foam or a resin foam concrete, said base support being provided at a location where the building is to be constructed;

a base made from concrete, said base being provided on said base support; and vibration absorbers each having a large number of cavities therein, said vibration absorbers being interposed between said base support and said base and arranged laterally to be spaced apart from each other, said base being directly fixed to the base support at portions where the vibration absorbers are not interposed between the base and the base support, and said base being fixed to the vibration absorbers at portion where the vibration absorbers are interposed between the base and the base support to thereby integrally unit the base support, base and vibration absorbers so that vibration applied to the base support is properly absorbed when it is transferred to the base.

2. A base structure of a building according to claim 1, wherein a compressive strength of said base support formed by the synthetic resin molded foam is in a range of 3 to 25 $t/m^2$.

3. A base structure of a building according to claim 1, wherein said vibration absorber is formed by a synthetic resin molded foam having through-holes which pass through said vibration absorber in a thickness direction.

4. A base structure of a building according to claim 1, wherein said vibration absorber is formed by a synthetic resin molded foam in which cavities are formed between foamed particles.

5. A base structure of a building according to claim 1, wherein a porosity of said vibration absorber is in a range of 15 to 40%.

6. A method of constructing a base structure of a building, comprising the steps of:

excavating ground to form a recess;

forming a base support in said recess by laying a synthetic resin molded foam in said recess, or placing resin foam concrete in said recess;

mounting a plurality of vibration absorbers each having a large number of cavities therein on said base support in such a manner that said vibration absorbers are laterally spaced apart from each other at specific intervals; and placing concrete on said base support on which said vibration absorbers have been mounted, to form a base, said base being directly fixed to the base support at portions where the vibration absorbers are not interposed between the base and the base support, and said base being fixed to the vibration absorbers at portion where the vibration absorbers are interposed between the base and the base support to thereby integrally unite the base support, base and vibration absorbers so that vibration applied to the base support is properly absorbed when it is transferred to the base.

7. A base structure of a building according to claim 1, further comprising plate bodies made from a synthetic resin molded foam and provided on at least a part of side surfaces of the base support.

8. A method of constructing a base structure of a building according to claim 6, further comprising a step of providing plate bodies made from a synthetic resin molded foam on at least a part of side surfaces of the base support.

* * * * *